US007634208B2

(12) United States Patent
Sugiyama

(10) Patent No.: US 7,634,208 B2
(45) Date of Patent: Dec. 15, 2009

(54) DRIVING DEVICE, IMAGE FORMING APPARATUS INCLUDING DRIVING DEVICE, AND CONTROL METHOD THEREFOR

(75) Inventor: Norikazu Sugiyama, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 11/408,969

(22) Filed: Apr. 24, 2006

(65) Prior Publication Data

US 2006/0251439 A1 Nov. 9, 2006

(30) Foreign Application Priority Data

May 6, 2005 (JP) ..... 2005-135426

(51) Int. Cl.
*G03G 15/20* (2006.01)

(52) U.S. Cl. ..... 399/68; 399/44; 399/45; 399/400

(58) Field of Classification Search ..... 399/44, 399/45, 68, 400
See application file for complete search history.

(56) References Cited

U.S. PATENT DOCUMENTS 4,941,021 A * 7/1990 Uchida et al. ..... 399/45
6,892,038 B2 5/2005 Fukutani ..... 399/68
6,909,859 B2 6/2005 Nakamura et al. ..... 399/50
7,426,353 B1 * 9/2008 Sakakibara ..... 399/400
2006/0051116 A1 * 3/2006 Koshida ..... 399/68
2006/0120744 A1 * 6/2006 Shirakata et al. ..... 399/68
2006/0222386 A1 * 10/2006 Koshida et al. ..... 399/44
2006/0222394 A1 * 10/2006 Koshida ..... 399/68
2007/0264033 A1 * 11/2007 Koshida ..... 399/16

FOREIGN PATENT DOCUMENTS

JP 05-107966 4/1993
JP 2000-352850 12/2000
JP 2003-316184 11/2003

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

It is desirable to reduce disturbance of an unfixed toner image by suppressing vibration of the trailing end of a recording medium, and to thereby stabilize the quality of a formed image. In a first control time period based on the leading edge of the recording medium as a reference, a driving unit is controlled in accordance with detection of a loop. On the other hand, in a control time period after the first control time period, a target speed is determined from a drive speed of the driving unit in the first control time period, and the driving unit is controlled by the determined target speed.

9 Claims, 12 Drawing Sheets

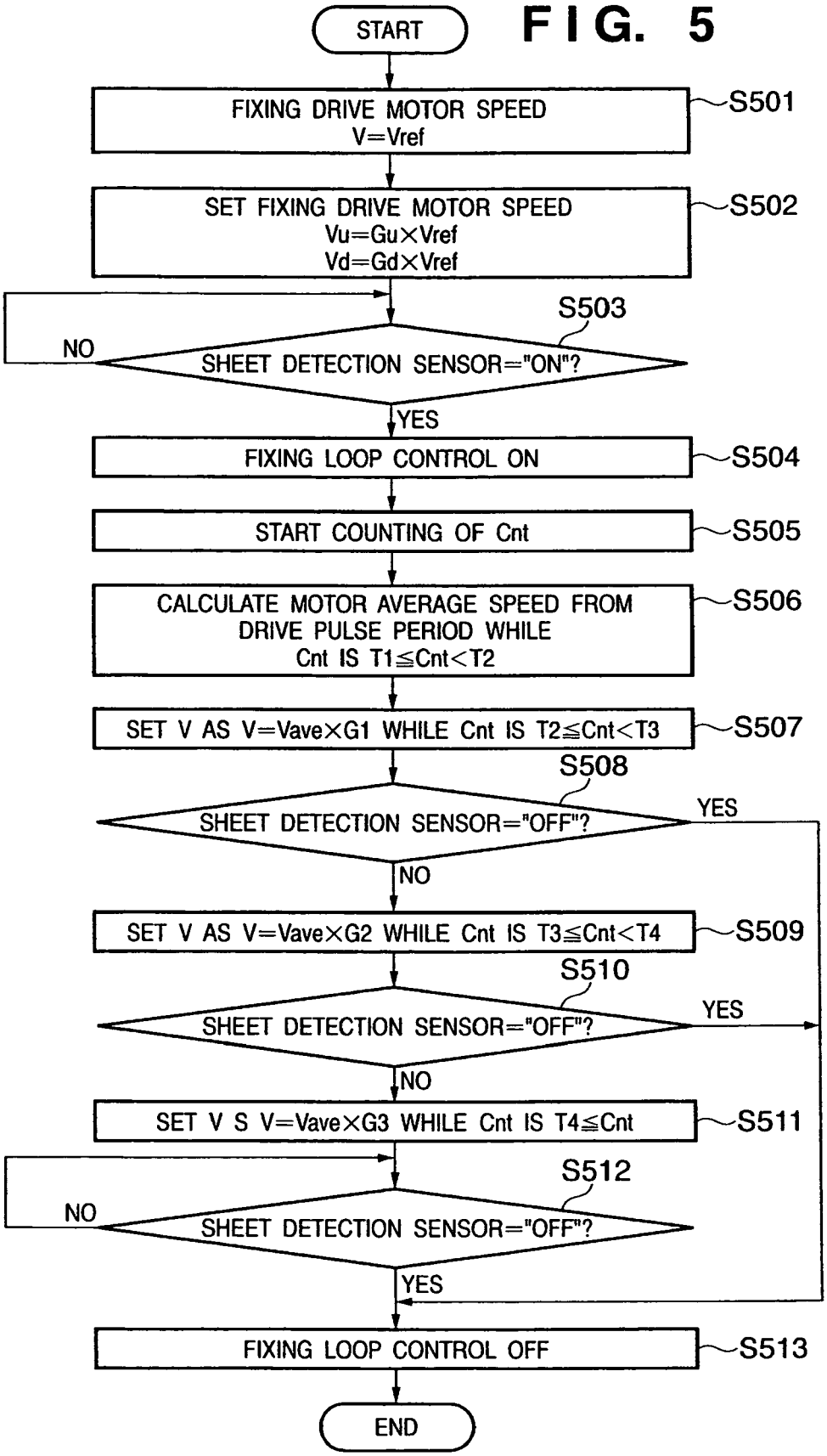
FIG. 5
START
FIXING DRIVE MOTOR SPEED
V=Vref
S501
SET FIXING DRIVE MOTOR SPEED
Vu=Gu×Vref
Vd=Gd×Vref
S502
S503
NO
SHEET DETECTION SENSOR="ON"?
YES
FIXING LOOP CONTROL ON
S504
START COUNTING OF Cnt
S505
CALCULATE MOTOR AVERAGE SPEED FROM
DRIVE PULSE PERIOD WHILE
Cnt IS T1≦Cnt<T2
S506
SET V AS V=Vave×G1 WHILE Cnt IS T2≦Cnt<T3
S507
S508
SHEET DETECTION SENSOR="OFF"?
YES
NO
SET V AS V=Vave×G2 WHILE Cnt IS T3≦Cnt<T4
S509
S510
SHEET DETECTION SENSOR="OFF"?
YES
NO
SET V S V=Vave×G3 WHILE Cnt IS T4≦Cnt
S511
S512
NO
SHEET DETECTION SENSOR="OFF"?
YES
FIXING LOOP CONTROL OFF
S513
END

FIG. 8

| PRINT MODE | CORRECTION GAIN 1 | CORRECTION GAIN 2 | CORRECTION GAIN 3 |
|---|---|---|---|
| REGULAR PAPER | 0.97 | 1.02 | 0.98 |
| THICK PAPER | 0.98 | 1.01 | 0.99 |

FIG. 10

| ENVIRONMENTAL HUMIDITY | CORRECTION GAIN 1 | CORRECTION GAIN 2 | CORRECTION GAIN 3 |
|---|---|---|---|
| LESS THAN A1 (LOW HUMIDITY) | 0.98 | 1.03 | 0.99 |
| NOT LESS THAN A1 AND LESS THAN A2 (NORMAL HUMIDITY) | 0.97 | 1.02 | 0.98 |
| NOT LESS THAN A2 (HIGH HUMIDITY) | 0.96 | 1.01 | 0.97 |

DRIVING DEVICE, IMAGE FORMING APPARATUS INCLUDING DRIVING DEVICE, AND CONTROL METHOD THEREFOR

FIELD OF THE INVENTION

The present invention relates to an image forming apparatus and to a driving device used in the image forming apparatus.

BACKGROUND OF THE INVENTION

Generally, an image forming apparatus controls a plurality of conveying units so as to form a certain amount of bending (loop) in a recording medium. By providing the loop in the recording medium, for example, the skewing of the recording medium during conveyance can be suppressed.

Such an electrophotographic type image forming apparatus performs control for passing the recording medium through a transferring part, while keeping a fixed amount of the loop formed in the recording medium. However, the sheet holding force of the transferring part is decreased as the trailing end of the recording medium passes through the plurality of transferring parts, so that the trailing end of the recording medium vibrates at the moment when the loop is released. This is the main cause of disturbance of an unfixed toner image and thus image defects.

In order to solve this problem, there is proposed a method in Japanese Patent Laid-Open No. 2003-316184, which controls fixing and conveying speeds so as to increase or decrease the loop amount in response to the arrival of the trailing end of the recording medium at a predetermined position on the upstream side of the transfer position in the conveying direction.

However, there arises a new problem that occurrence of erroneous detection of the loop amount increases, as the path from the transferring part toward the fixing part is shortened in accordance with miniaturization of the image forming apparatus in recent years.

The invention described in Japanese Patent Laid-Open No. 2003-316184 is an excellent invention in that the loop amount is controlled so as to be increased or decreased on the basis of the trailing end of the recording medium as a reference. Specifically, the control is effective to suppress vibration of the trailing end of the recording medium. However, the loop amount may become excessive at the trailing end of a sheet in a constitution in which the path between the transferring part and the fixing part is further shortened. When the loop amount becomes excessive, the sheet may be pressed into the transferring part, resulting in a possibility of an image defect being caused.

Further, the pressure of a nip part between a fixing roller and a pressing roller in the fixing part is generally set to be different between the central part and the end part of the rollers. This is a measure for preventing wrinkles of the sheet from being caused after fixation. The pressure difference in the nip part causes a difference in the loop amount between the central part and the end part in the fixing part. In the constitution in which the path between the transferring part and the fixing part is short, such difference in the loop amount affects color slurring in the transferring part.

Consequently, there is a room for improvement in suppressing image defects, in order to attain further miniaturization of the image forming apparatus.

SUMMARY OF THE INVENTION

According to the present invention, in a first control time period based on the leading edge of a recording medium as a reference, a driving portion is controlled in accordance with detection of a loop. On the other hand, in one or more following control time periods after the first control time period, one or more target speeds are determined from the average speed of the driving portion in the first control time period, and the driving portion is controlled by the determined target speeds.

According to the present invention, vibration of the trailing end of the recording medium is suppressed by controlling the driving portion on the basis of the target speeds determined in accordance with the average speed of the driving portion, rather than by simply performing speed control in accordance with the detection of the loop. This makes it possible to reduce disturbance of an unfixed toner image and to stabilize the quality of a formed image.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a flowchart relating to the image forming apparatus according to the embodiment and the driving device used in the image forming apparatus;

FIG. 8 is a table showing exemplary data according to an embodiment, in which correction gains for each printing mode are stored;

FIG. 10 is a table showing exemplary data according to an embodiment, in which correction gains for each level of ambient humidity are stored;

DETAILED DESCRIPTION OF THE PREFERRED EMBODIMENTS

First Embodiment

Figure 1:
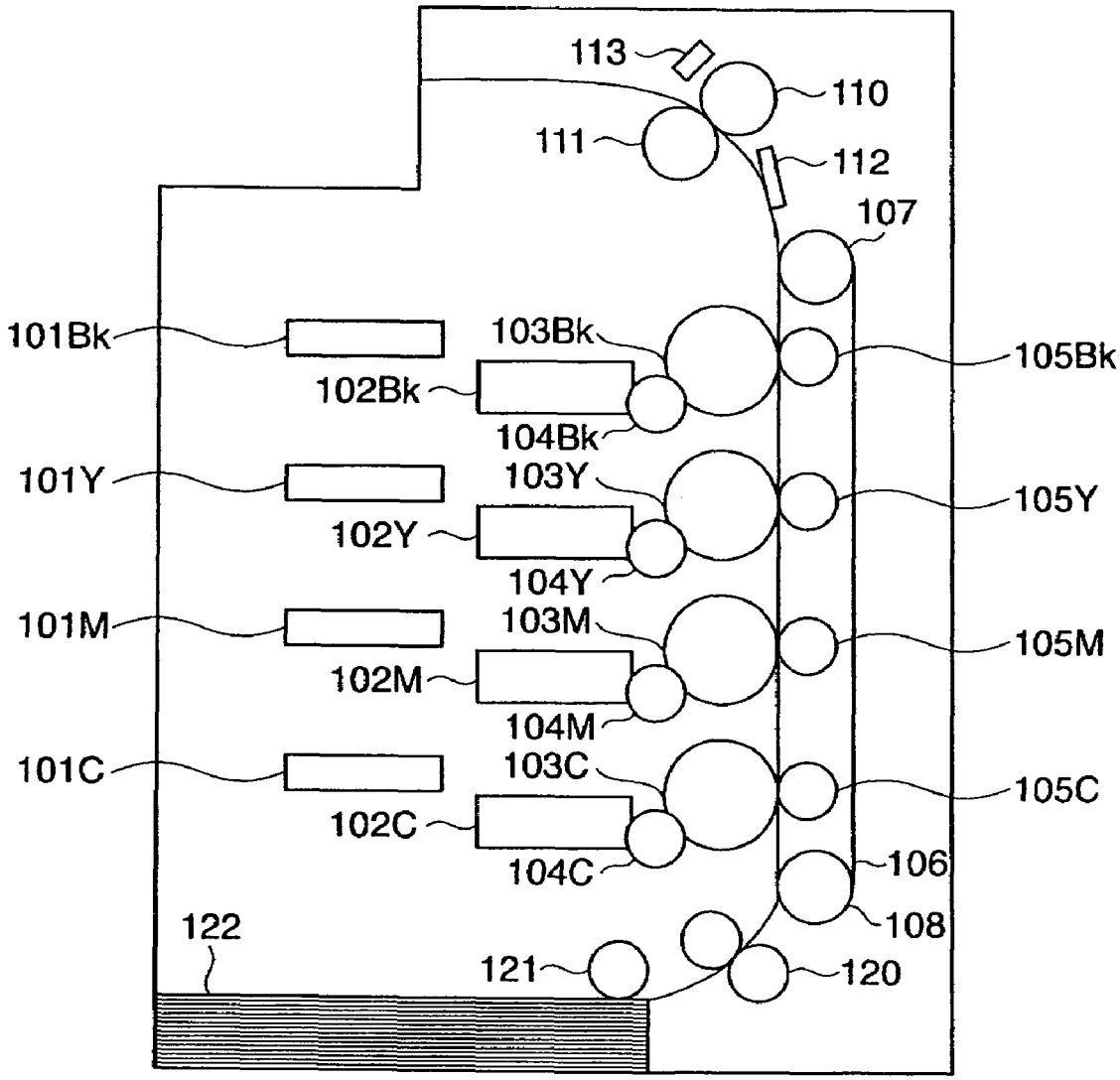
FIG. 1 is a sectional view showing a schematic configuration of a color image forming apparatus according to an embodiment.

FIG. 1 is a sectional view showing a schematic configuration of a color image forming apparatus according to an embodiment. In the present embodiment, a color image forming apparatus provided with image forming units of four colors, (namely, yellow: Y, magenta: M, cyan: C, black: Bk), is explained as an example. Of course, it goes without saying that the present invention can be applied to a monocolor image forming apparatus and the other color image forming apparatuses.

In FIG. 1, reference characters 103Y, 103M, 103C and 103Bk (in which Y, M, C and Bk are suffixes representing yellow, magenta, cyan and black, respectively), denote photosensitive drums, each (hereinafter simply referred to as a photosensitive drum 103), forming an electrostatic latent image. Reference characters 101Y, 101M, 101C and 101Bk denote laser scanners, each (hereinafter simply referred to as a laser scanner 101), executing the exposure in accordance with an image signal and forming an electrostatic latent image on the photosensitive drum 103. Reference characters 102Y, 102M, 102C and 102Bk denote developing units, each (hereinafter simply referred to as a developing unit 102), holding a toner of each color. Reference characters 104Y, 104M, 104C and 104Bk denote developing rollers, each (hereinafter simply referred to as a developing roller 104), developing the electrostatic latent image with each toner.

Reference numeral 106 denotes a conveying belt successively conveying sheets (which may be referred to as transfer materials, recording materials or a recording media), to the image forming units of each color. The conveying belt 106 also serves as a transfer belt. Noted, it goes without saying that the conveying belt 106 is an example of an endless carrier. Reference numeral 107 denotes a drive roller which is connected with a driving unit constituted by a motor, a gear (not shown) and the like, and which drives the conveying belt 106. Reference numeral 108 denotes a driven roller which rotates in accordance with the movement of the conveying belt 106, and provides a fixed tension to the conveying belt 106. Reference characters 105Y, 105M, 105C and 105Bk denote so-called transfer rollers, (each hereinafter simply referred to as a transfer roller 105).

Reference numeral 110 denotes a fixing roller which heats the sheet. Reference numeral 111 denotes a pressing roller which conveys the sheet, and which gives a rotating force to the fixing roller 110 and presses the fixing roller 110. Mainly, the fixing roller 110 and the pressing roller 111 constitute a so-called fixing-unit.

Reference numeral 112 denotes a loop detection sensor. A loop is formed in the sheet by a part (hereinafter referred to as a transferring part) in which the photosensitive drum 103 approaches the transfer roller 105, and by the fixing roller 110. Reference numeral 113 denotes a sheet detection sensor which detects the passage of the sheet. The sheet detection sensor 113 is provided on the downstream side of the fixing roller 110 in the sheet conveying direction. Noted that the sheet detection sensor 113 may be provided at an optional position on the upstream side of the fixing roller 110 in the conveying direction.

Reference numeral 122 denotes a sheet cassette for storing the sheet. Reference numeral 121 denotes a pickup roller for feeding the sheet one by one to a pair of resist rollers 120.

Figure 2:
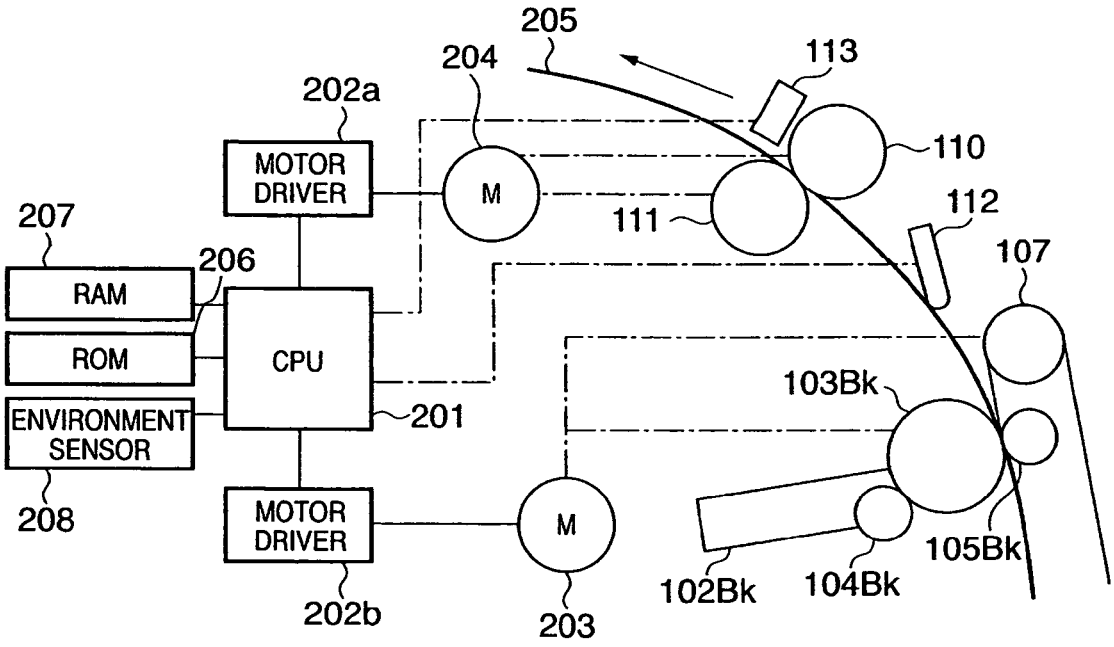
FIG. 2 is a figure showing an example of a driving device according to the embodiment.

FIG. 2 is a figure showing an example of a driving device according to the present embodiment. A CPU 201 is a control unit which controls a developing cartridge drive motor 203 and a fixing-unit drive motor 204. A motor driver 202*a* is a drive circuit which drives the developing cartridge drive motor 203 in response to a control instruction from the CPU 201. A motor driver 202*b* is a drive circuit which drives the drive motor 204 in response to a control instruction from the CPU 201. The developing cartridge drive motor 203 is a motor which drives the developing unit 102Bk on the most downstream side in the conveying direction, as well as the drive roller 107 for driving the endless conveying belt 106. The drive motor 204 is a motor for driving the fixing roller 110 and the pressing roller 111. Each of these motors can be realized by, for example, a stepping motor. Reference numeral 205 denotes a sheet. Noted that a control program and data required for the control are stored in a ROM 206. In addition, a RAM 207 is used as a work area of the CPU 201. Reference numeral 208 denotes an environment sensor for obtaining environmental parameters, such as environmental temperature and environmental humidity.

Upon receipt of data to be printed from a PC, the CPU 201 controls the feeding of sheets from the sheet cassette 122 to the conveying belt 106. The sheets are conveyed one by one to the image forming units of each color by the conveying belt 106. The CPU 201 feeds image signals for each color to each laser scanner 101 in synchronization with the sheet conveyance performed by the conveying belt 106. Thereby, electrostatic latent images are formed on the photosensitive drum 103. The electrostatic latent images are developed by the developing unit 102, and transferred onto the sheet by the transferring part. Thereafter, the sheet 205 is separated from the conveying belt 106, and the toner image is fixed on the sheet 205 in the fixing-unit. The sheet 205 is then discharged to the outside.

Figure 3:
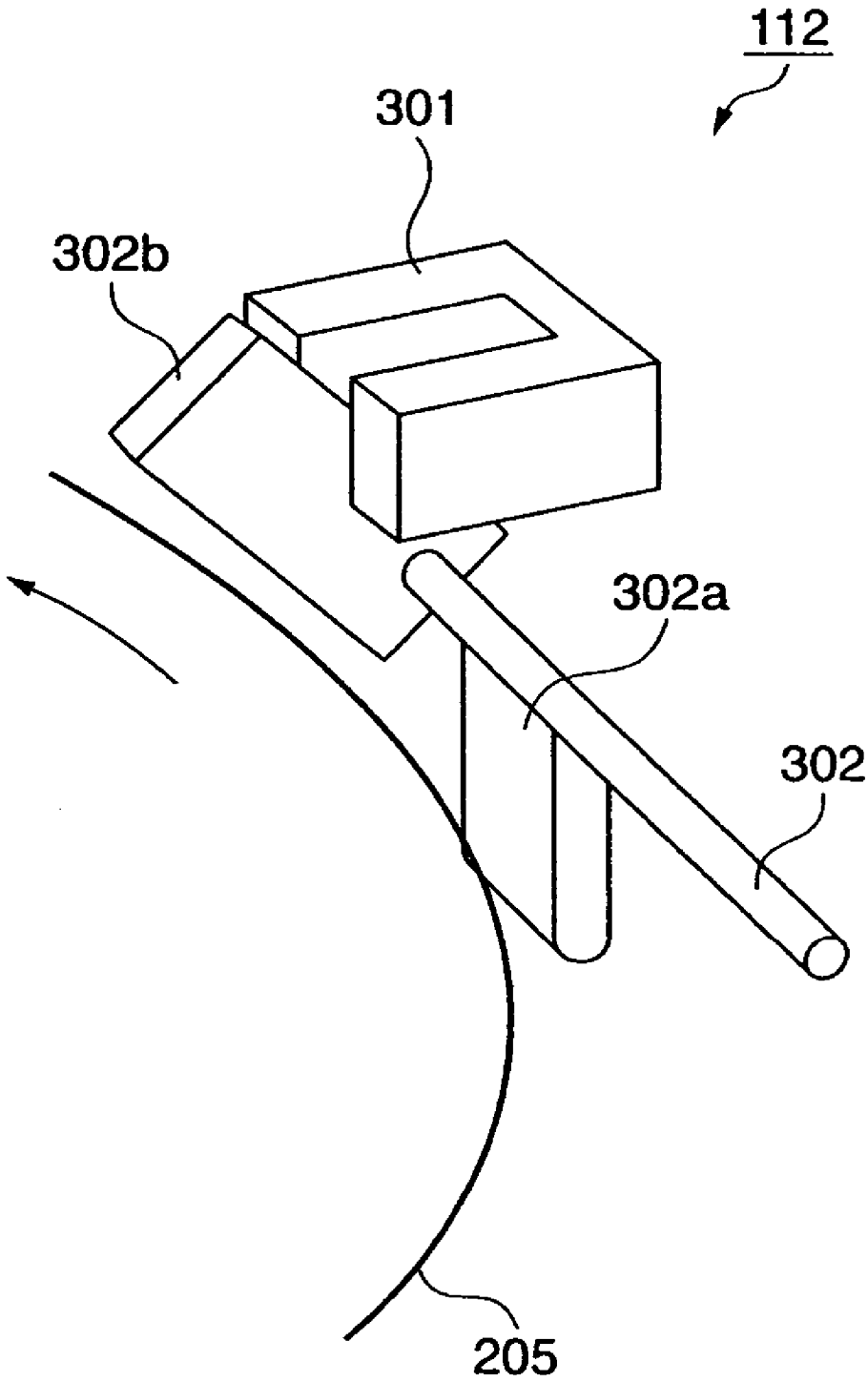
FIG. 3 is a figure showing an operation of a loop detection sensor according to the embodiment.
Figure 4:
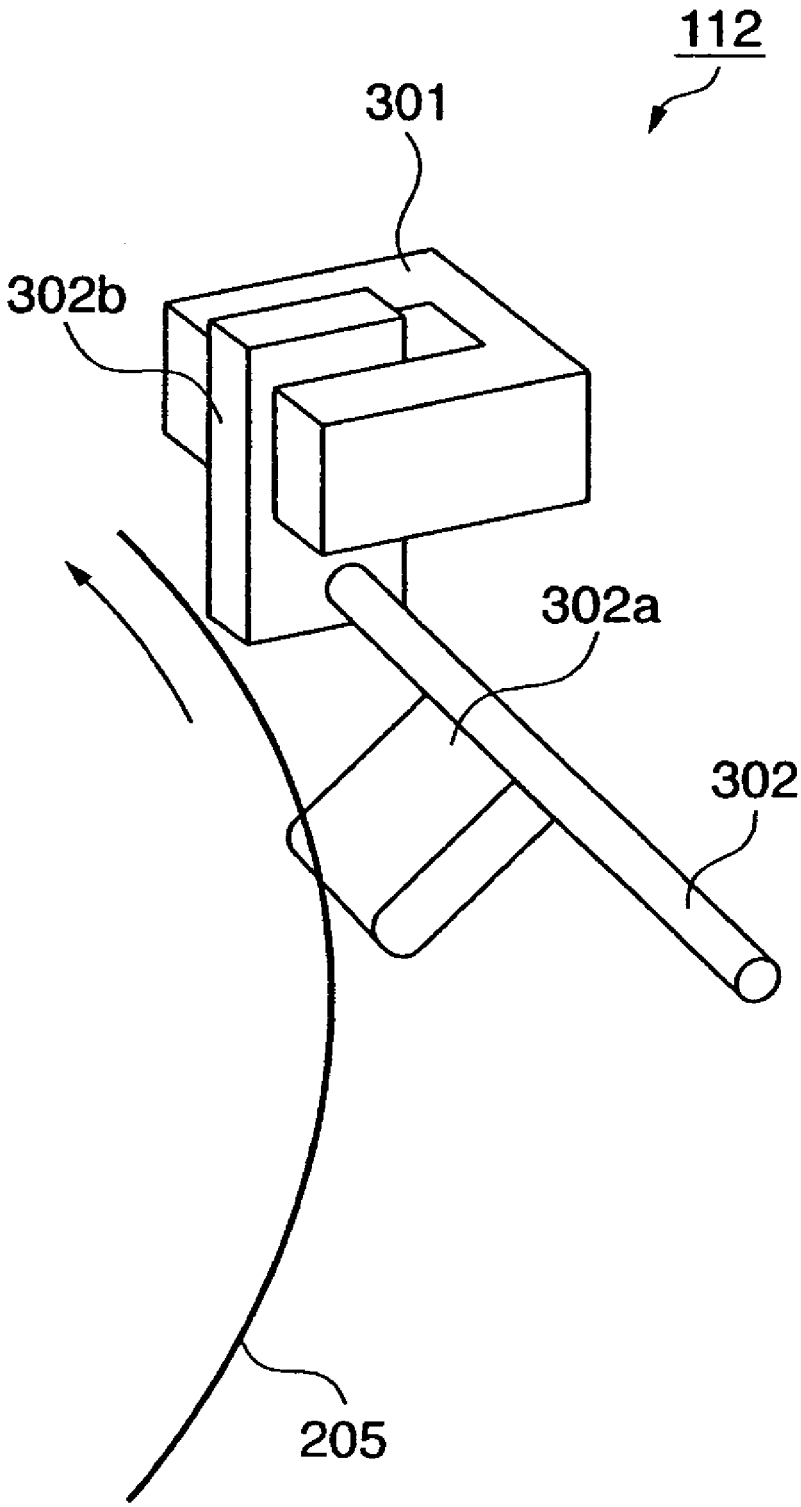
FIG. 4 is a figure showing the operation of the loop detection sensor according to the embodiment.

FIG. 3 and FIG. 4 are figures showing an operation of the loop detection sensor according to the present embodiment, respectively. Reference numeral 301 denotes a photointerrupter which detects interrupting of light. Reference numeral 302 denotes a mechanical flag which is moved through contact with the sheet 205. The mechanical flag 302 includes a sheet contact member 302*a* and a light interrupting member 302*b*.

In particular, FIG. 3 shows a position of each part when the loop sensor is in "ON" state. On the other hand, FIG. 4 shows a position of each part when the loop sensor is in "OFF" state. When a loop is formed in the sheet 205, the sheet contact member 302*a* of the mechanical flag 302 is pushed by the sheet. Thereby, the mechanical flag 302 is rotated and the light interrupting member 302*b* blocking light to the photointerrupter 301 is rotated, so that the blocking of light is released. That is, the state of "loop sensor OFF" is changed to the state of "loop sensor ON". In this way, it possible to detect that a loop of a predetermined amount is formed.

FIG. 5 is an exemplary flowchart relating to the image forming apparatus according to the present embodiment, and to the driving device used in the image forming apparatus. The control method according to the flowchart is started upon receipt of image data transmitted from a video controller (not shown) and the like.

In step S501, the CPU 201 transmits a control instruction to the motor driver 202*a*, and sets a speed setting value of the drive motor 204 to a reference speed value Vref. The motor driver 202*a* performs control in accordance with the control instruction so that the rotation speed of the drive motor 204 reaches the reference speed value Vref. Noted that as described above, a toner image is transferred to the fed sheet when the sheet passes through each transferring part.

In step S502, the CPU 201 sets the speed of the drive motor 204 on the basis of the following formula.

$$Vu=Gu\times Vref(Gu>1) \quad \text{(formula 1)}$$

$$Vd=Gd\times Vref(Gd<1) \quad \text{(formula 2)}$$

Here, Vu is a target speed which is applied when the loop is detected. Gu is one of coefficient data (gain) for calculating Vu, which can be arbitrarily set, when it is higher than the process speed. In the present embodiment, as an example, Vu is set as Vu=1.01×Vref which is 101% of the process speed.

Vd is a target speed which is applied when the loop is not detected. Gd is one of coefficient data (gain) for calculating Vd, which can be arbitrarily set, when it is higher than the process speed. In the present embodiment, as an example, Vd is set as Vd=0.99×Vref, which is 99% of the process speed.

In step S503, the CPU 201 determines whether or not the leading edge of the sheet to which a full color toner image is transferred reaches the sheet detection sensor 113. For example, the CPU 201 monitors whether or not the output of the sheet detection sensor 113 is turned ON. When the sheet reaches the sheet detection sensor 113, the CPU 201 proceeds to step S504.

In step S504, the CPU 201 validates fixing loop control for controlling the conveying unit, so as to make the loop amount kept constant. That is, the CPU 201 performs speed control by successively applying the target speeds of Vu, Vd of the drive motor 204 in accordance with the output of the loop detection sensor 112.

In step S505, the CPU 201 starts a time counting operation by using a counter Cnt in accordance with the detection of the leading edge of the sheet by the sheet detection sensor 113.

In step S506, the CPU 201 stores a drive pulse period for the drive motor 204 in the RAM 207, while the counted time of the counter Cnt is T1≦Cnt<T2. The drive pulse period may be considered as a period of a phase signal for the motor. Further, the CPU 201 calculates an average speed Vave of the drive motor 204 during the time period of T1≦Cnt<T2, on the basis of the drive pulse period. Here, T1, T2 respectively represent timings based on the detection of the leading edge of the sheet by the sheet detection sensor 113, as a reference.

Since suitable values of such timings are different depending upon the structure of the image forming apparatus or the driving device, it is desirable to empirically determine the values in advance by a test and the like. Of course, needless to say, it is desirable to set the values of the timings to values which enable vibration of sheet trailing end to be suitably reduced. In this case, the values of T1, T2 may be held as a part of the control program stored in the ROM 206, or may be separately stored in the ROM 206 as data. The same also applies to the values of T3, T4 as will be described below.

In step S507, the CPU 201 sets a target speed V of the drive motor 204 during a time period in which the counted time of the counter Cnt is T2≦Cnt<T3, on the basis of the average speed Vave. Noted that T3 is one of the timings based on the detection of the leading edge of the sheet by the sheet detection sensor 113, as the reference.

$$V = Vave \times G1 \quad \text{(formula 3)}$$

Here, G1 is one of coefficient data (correction gain) for calculating the average speed Vave. The value of G1 can be arbitrarily set, but needless to say, it is desirable to set G1 to a value which enables vibration of the sheet trailing end to be suitably reduced. For example, when G1 is set to 0.97, the target speed V during the time period of T2≦Cnt<T3 is set as V=0.97×Vave. This means that the drive motor 204 is driven at a speed of 97% of the average speed.

In step S508, the CPU 201 monitors whether or not the output of the sheet detection sensor 113 is turned OFF during the time period in which the counted time of the counter Cnt is T2≦Cnt<T3. When the output of the sheet detection sensor 113 is turned OFF, the CPU 201 proceeds to step S513. On the other hand, when the output of the sheet detection sensor 113 is kept ON, the CPU 201 proceeds to step S509.

In step S509, the CPU 201 sets the target speed V of the drive motor 204 during a time period in which the counted time of the counter Cnt is T3≦Cnt<T4, on the basis of the average speed Vave.

$$V = Vave \times G2 \quad \text{(formula 4)}$$

Here, G2 is one of the coefficient data (correction gain) for correcting the average speed Vave. It is desirable to set G2 to a value which enables vibration of the sheet trailing end to be suitably reduced similarly to G1. In the present embodiment, G2 is set to 1.02 as an example. This means that the drive motor is driven at a speed of 102% of the average speed. Here, T4 is a timing based on the detection of the leading edge of the sheet by the sheet detection sensor 113, as the reference. It is also desirable to set this timing to a value which enables vibration of the sheet trailing end to be suitably reduced, similarly to the timings T1 to T3.

In step S510, the CPU 201 monitors whether or not the output of the sheet detection sensor 113 is turned OFF in the time period in which the counted time of the counter Cnt is T3≦Cnt<T4. When the output of the sheet detection sensor 113 is turned OFF, the CPU 201 proceeds to step S513. On the other hand, when the output of the sheet detection sensor 113 is kept ON, the CPU 201 proceeds to step S511.

In step S511, the CPU 201 sets the target speed V of the drive motor 204 during the time period in which the counted time of the counter Cnt is T4≦Cnt, on the basis of the average speed Vave.

$$V = Vave \times G3 \quad \text{(formula 5)}$$

Here, G3 is one of the coefficient data (correction gain) for correcting the average speed Vave. It is desirable to set G3 to a value which enables vibration of the sheet trailing end to be suitably reduced, similarly to the values of G1, G2. In the present embodiment, G3 is set to 0.98 as an example. This means that the drive motor is driven at a speed of 98% of the average speed.

In step S512, the CPU 201 monitors whether or not the output of the sheet detection sensor 113 is turned OFF in a time period in which the counted time of the counter Cnt is T4≦Cnt. When the output of the sheet detection sensor 113 is turned OFF, the CPU 201 proceeds to step S513.

In step S513, the CPU 201 invalidly sets (terminates) the fixing loop control and sets the speed setting value of the drive motor 204 to the reference speed value Vref.

Figure 6:
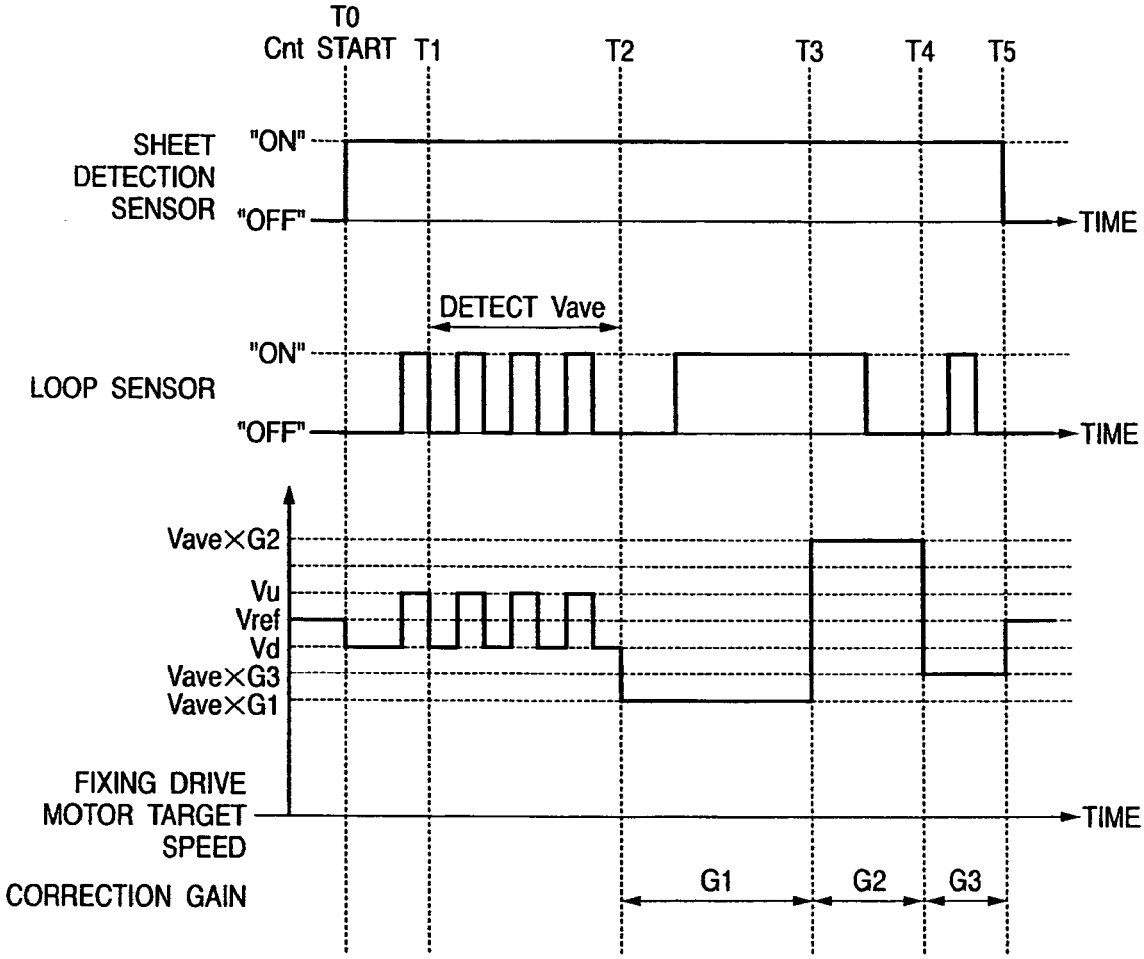
FIG. 6 is a timing chart showing the operation of the image forming apparatus according to the embodiment.

FIG. 6 is a timing chart showing an operation of the image forming apparatus according to the present embodiment. This timing chart corresponds to the flowchart shown in FIG. 5. For example, T1, T2, T3 and T4 (representing time periods from the leading edge of the sheet, respectively) are set as T1=0.5 sec, T2=2.0 sec, T3=3.0 sec and T4=5.3 sec. The time periods T1, T2, T3 and T4 can be suitably changed in accordance with the conveying path length of the image forming apparatus, the conveying speed of the sheet and the like. Therefore, it is desirable to perform an experiment in advance, so as to set the time periods T1, T2, T3 and T4 to suitable values.

In the FIG. 6, T0 represents the timing at which the leading edge of the sheet reaches the sheet detection sensor 113. In T0, the time counting by the counter Cnt is started and the fixing loop control is made valid (S504, S505). During the time period of T0≦Cnt<T2, the CPU 201 switches over the target speeds Vu, Vd of the drive motor 204 in accordance with the result of detection by the loop detection sensor 112 (S506). Further, during the time period of T1≦Cnt<T2, the CPU 201 calculates the average speed of the drive motor 204, and sets the calculated result as the Vave.

Thereafter, in each control time period after T2, the drive motor 204 is driven in accordance with the target speeds (such as Vave×G1, Vave×G2, Vave×G3) calculated on the basis of the suitable correction gains and the average speed.

Figure 7:
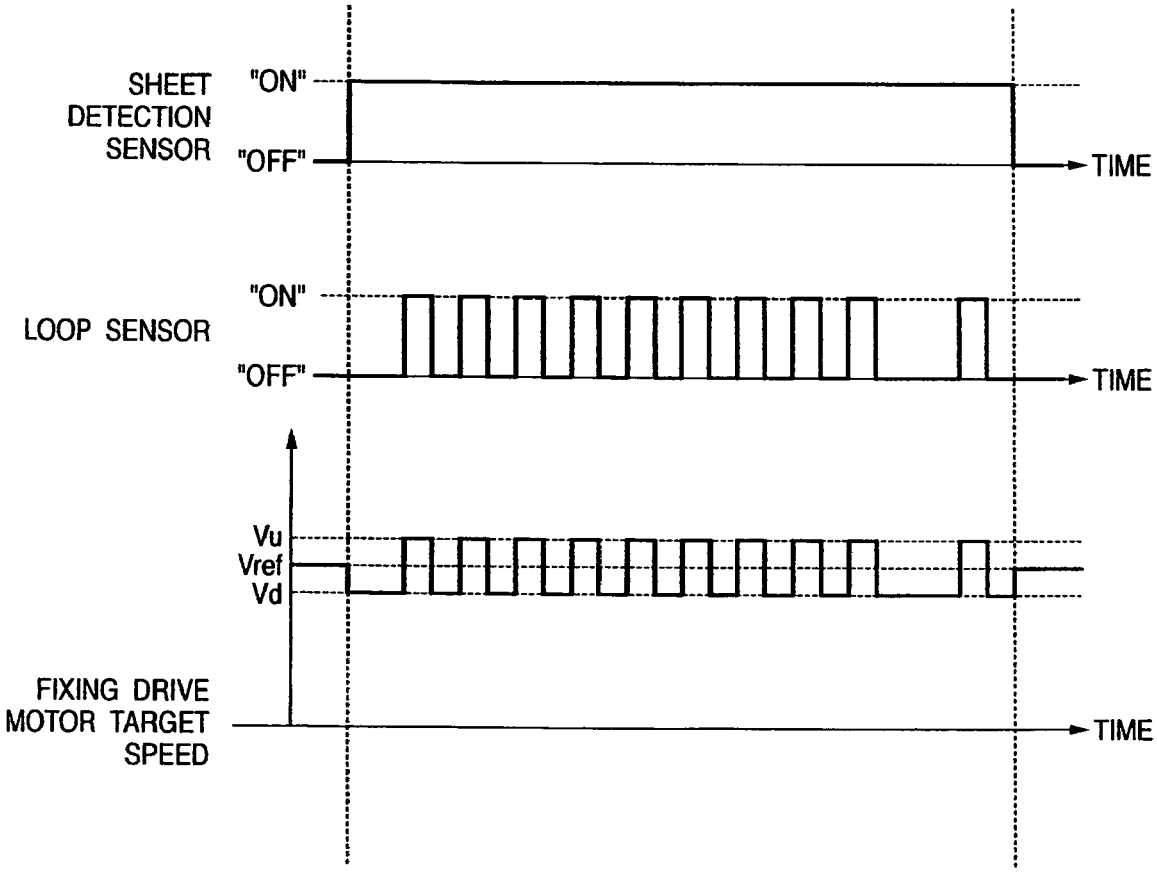
FIG. 7 shows a comparison example of the timing chart.

FIG. 7 shows a comparison example of the timing chart. As seen in comparison with FIG. 6, in the comparison example shown in FIG. 7, Vu, Vd are simply switched over in association with the detection result of the loop sensor. In this case, there is a possibility that vibration of the sheet trailing end cannot be suitably suppressed as described above.

On the other hand, according to the present embodiment, the drive motor 204 is controlled and driven in accordance with the detection of the loop in the first control time period (example: T1 to T2) based on the leading edge of the sheet as a reference. Then, in one or more control time periods (example: T2 to T5) after the first control time period, one or more target speeds (examples: Vave×G1, Vave×G2, Vave×G3 and the like) are determined from the average speed (example: Vave) of the drive motor 204 in the first control time period, and the drive motor 204 is controlled and driven at the determined target speeds. Thereby, vibration of the sheet trailing end can be suitably suppressed, so that the quality of a formed image can be stabilized.

Further, vibration of the sheet trailing end can be highly suitably suppressed by switching over the target speeds for each of the plurality of timings (examples: T2, T3, T4) based on the leading edge of the sheet as the reference, after the first control time period.

Further, the trouble of individually calculating the coefficient data (example: G1, G2, G3) which are used to determine the one or more target speeds can be eliminated by storing in advance the one or more coefficient data in the ROM and the like. Noted that the coefficient data may be dynamically obtained.

Second Embodiment

In a second embodiment, a technique is explained in which the coefficient data (correction gain) for obtaining the target speed are switched over in accordance with parameters relating to the occurrence of the loop. In the present embodiment, suitable coefficient data are particularly adopted on the basis of the basis weight of the sheet (example: thick paper, regular paper and the like) or on the basis of the conveying speed.

Generally, the nip thickness of the fixing-unit is changed by the material such as the kind and thickness of the sheet, which makes it necessary to switch over the printing mode (such as conveying speed of the sheet).

FIG. 8 is a table showing exemplary data in which the correction gains for each print mode according to the present embodiment are stored. Generally, thick paper has a higher stiffness than that of regular paper, so that the degree of arched shape of thick paper is smaller than that of the regular paper. This means that the loop amount of thick paper in the conveying direction is more uniform than that of regular paper. Therefore, in this table, absolute values of the correction gain of thick paper mode are set to be smaller than those of a regular paper mode.

Figure 9:
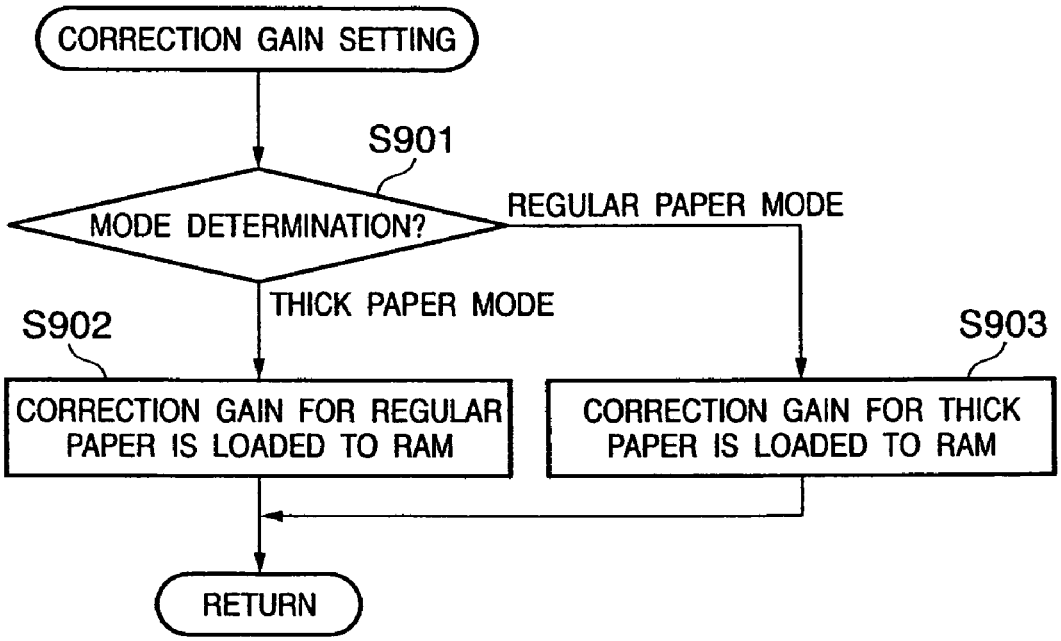
FIG. 9 is an exemplary flowchart showing setting processing of the correction gain according to the embodiment.

FIG. 9 is an exemplary flowchart showing setting processing of the correction gain according to the present embodiment. This processing is merely required to be performed, at the latest, until the target speeds applied to the time periods between respective timings are calculated.

In step S901, the CPU 201 determines the print mode instructed from an operation part (not shown) and the like. When the regular paper mode is instructed, the CPU 201 proceeds to step 902 and reads correction gains G1, G2, G3 for the regular paper mode, so as to make the correction gains loaded to the RAM 207. On the other hand, when the thick paper mode is instructed, the CPU 201 proceeds to step 903, and reads correction gains G1, G2, G3 for the thick paper mode, so as to make the correction gains loaded to the RAM 207. The correction gains loaded in this way are used in steps of S507, S509 and S511.

As described above, according to the present embodiment, the correction gains are switched over for each of various print modes. Thereby, vibration of the sheet trailing end can be suitably suppressed in accordance with the characteristic for each print mode, so that a formed image can be further stabilized.

Third Embodiment

In a third embodiment, an example is explained in which the correction gain is switched over on the basis of the environmental temperature and the environmental humidity, as the other parameters relating to the occurrence of the loop. Generally, the nip thickness of the fixing roller 110 is changed by the environmental temperature and the environmental humidity. The change in the nip thickness causes the arched amount of the sheet to be changed, so that the loop amount at the both ends of the sheet is also changed. Thus, it is desirable to set a suitable target speed in accordance with the environmental temperature and the environmental humidity.

FIG. 10 is a table showing exemplary data according to the present embodiment, in which correction gains for each level of the environmental humidity are stored. In this example, correction gains 1, 2, 3 are respectively stored for the case where the detection result Tc of the environmental humidity is less than A1 (low humidity), the case where the detection result Tc is not less than A1 and less than A2 (normal humidity) and the case where the detection result Tc is not less than A2 (high humidity). The relationship between the threshold values such as A1, A2 and each correction gain depends on the structure of the image forming apparatus and the driving device, and hence, suitable threshold values are determined in advance by an experiment and the like.

When the environmental humidity is lower than the normal humidity, the moisture content of the sheet is decreased so that the arched amount of the sheet is increased. As a result, the difference in the loop amount of the sheet between the central part and both end parts of the sheet in the conveying direction in the low humidity environment becomes large as compared with the difference in the normal humidity environment. Therefore, the absolute values of the correction gains in the low humidity environment are set larger than those in the normal humidity environment, so as to increase the correction amount.

On the other hand, when the environmental humidity is higher than the normal relative humidity, the moisture content of the sheet is increased so that the arched amount of the sheet is decreased. As a result, the loop amount of the sheet in the high humidity environment becomes more uniform in the conveying direction as compared with the loop amount in the normal humidity environment. Therefore, the absolute values of the correction gains in the high humidity environment are set smaller than those in the normal humidity environment.

Figure 11:
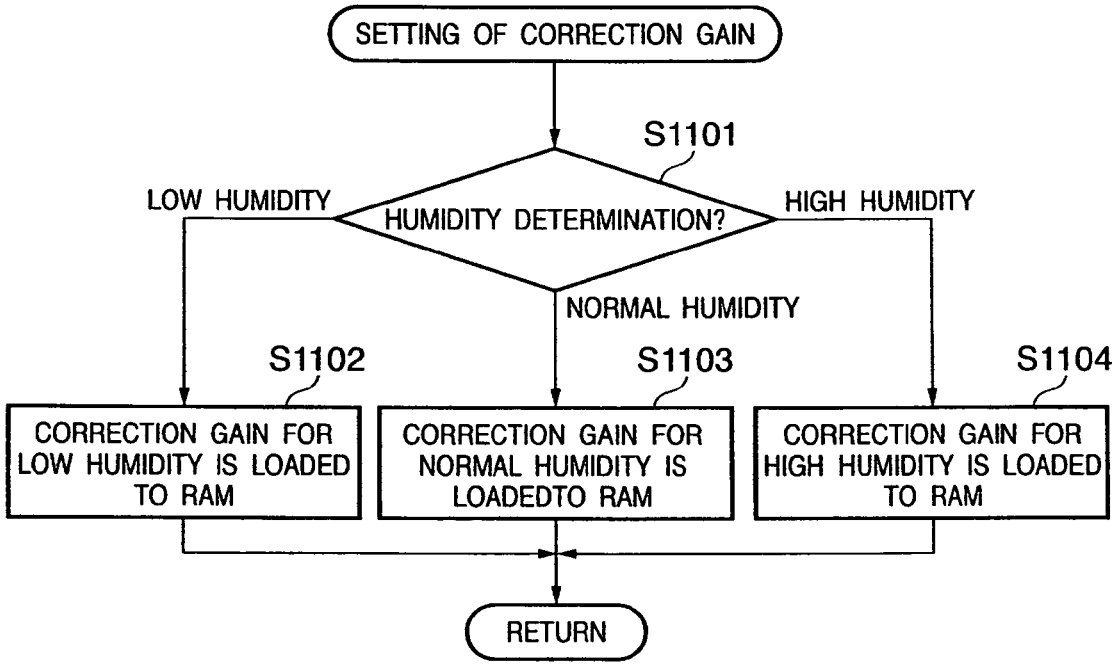
FIG. 11 is an exemplary flowchart showing setting processing of the correction gain according to the embodiment.

FIG. 11 is an exemplary flowchart showing setting processing of the correction gain according to the present embodiment. This processing is merely required to be performed, at the latest, until the target speeds applied to the time periods between respective timings are calculated.

In step S1101, the CPU 201 determines the extent of the present environmental parameter (for example, humidity) by using the environment sensor 208. When the humidity is low, the CPU 201 proceeds to step S1102, and reads the correction gains G1, G2, G3 for the low humidity environment from the ROM 206, so as to make the correction gains loaded to the RAM 207. When the humidity is normal, the CPU 201 proceeds to step S1103, and reads the correction gains G1, G2, G3 for the normal humidity environment from the ROM 206, so as to make the correction gains loaded to the RAM 207. Further, when the humidity is high, the CPU 201 proceeds to step S1104, and reads the correction gains G1, G2, G3 for the high humidity environment from the ROM 206, so as to make the correction gains loaded to the RAM 207. The correction gains loaded in this way are used in S507, S509 and S511.

As described above, according to the present embodiment, the correction gain is switched over for each environmental parameter. Thereby, vibration of the sheet trailing end can be suitably suppressed in accordance with each environmental parameter, so that a formed image can be further stabilized.

Other Embodiment

In the above-described embodiments, the photosensitive drums 103 are adopted as the media for forming latent images, but it goes without saying that a belt-like photosensitive may also be suspended and driven by the drive roller. Further, the endless carrier is adopted as the paper conveying belt 106, but the paper conveying belt 106 may be an intermediate transfer body.

Further, whether or not the sheet is conveyed to the fixing roller 110 is detected by the sheet detection sensor 113, but the loop detection sensor 112 may also be used for this purpose. For example, the drive speed of the drive motor 204 is set to a speed lower than the reference speed value Verf until the sheet is conveyed to the fixing roller 110. Thereby, a loop of the sheet is formed between the transfer part and the fixing part, and the passage of the sheet is determined by the change in the output signal of the loop detection sensor 112.

Further, in the above-described embodiments, the control time period after the initial control time period is set to be divided into three (T2 to T3, T3 to T4, T4 to T5), but the number of time periods is not limited to this value, provided that the control time period after the initial control time period is divided into two or more. Further, the correction gains need not be values different from each other. This is because the correction values need only to be selected so as to enable vibration at the sheet trailing end to be suitably suppressed.

There is also known a method in which the pressure force at both ends of the pressing roller 111 is set larger than that in the center of the pressing roller 111 in order to prevent wrinkles from being caused on the sheet when the sheet is discharged from the fixing-unit. Thereby, in a part immediately close to the upstream side of the fixing-unit, a so-called arched shape is formed, in which shape the central part of the sheet is raised upward and the both ends of the sheet are lowered downward.

Figure 12:
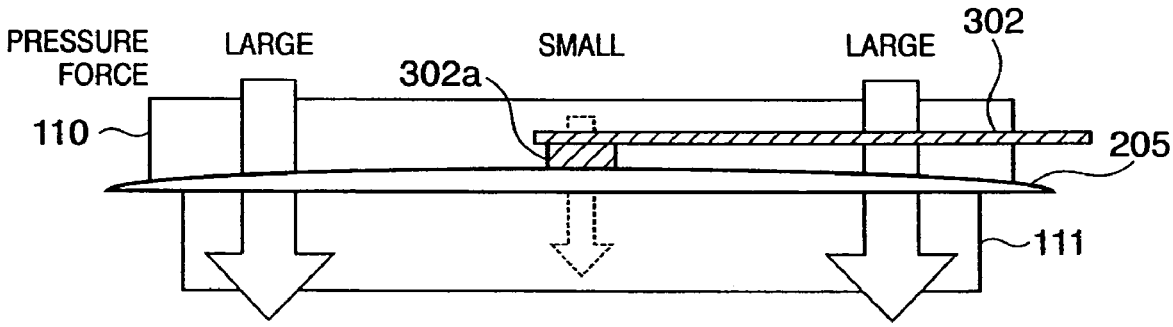
FIG. 12 is a figure showing an arched shape.

FIG. 12 is a figure shows the arched shape. This figure shows a state where the entrance of the fixing-unit is seen from the side of the transferring part. In this example, the loop detection sensor is arranged in the central part of the sheet.

The loop amount at both ends of the sheet which is formed into the arch shape, is smaller than the loop amount at the center of the sheet. In the conventional method, this causes vibration to occur at the sheet trailing end, even when the conveying unit is controlled to make the amount of the loop at the center of the sheet kept constant. In order to avoid the occurrence of vibration, it is also considered to arrange the loop detection sensor at an end part which is hardly influenced by the change in the sheet in the sheet conveying direction. However, the sheet with a narrow width may not pass the end part in which the loop detection sensor is arranged. Therefore, in order to detect at a height the loop of sheets with various width, it is also desirable to provide the sensor in the central part of the sheet.

Further, it is also considered to arrange a plurality of loop detection sensors at the central part and at the end parts of the sheet, but the increase in the number of the sensors causes the cost of the image forming apparatus to increase.

On the contrary, according to the present embodiment, the drive motor 204 is controlled and driven in accordance with the detection of the loop during the first control time period (example: T1 to T2) based on the leading edge of the sheet as a reference. Then, in one or more control time periods (example: T2 to T5) after the first control time period, one or more target speeds (example: Vave×G1, Vave×G2, Vave×G3 and the like) are determined from the average speed (example: Vave) of the drive motor 204 in the first control time period, so that the drive motor 204 is controlled and driven on the basis of the determined target speeds. As a result, it is possible to suitably suppress vibration of the sheet trailing end, and to thereby to stabilize the quality of a formed image. That is, vibration of the sheet trailing end can be suppressed by providing only one loop detection sensor 112 near the central part of the sheet, which is significantly advantageous from the viewpoint of cost.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-135426 filed on May 6, 2005, which is hereby incorporated by reference herein its entirety.

What is claimed is:

1. A driving device comprising:

a conveying portion which conveys a recording medium;

a driving portion which drives a fixing-unit for fixing the recording medium conveyed by the conveying portion;

a detection portion which detects a loop of the recording medium between the conveying portion and the fixing-unit; and a control portion which, in a first control time period starting from the time when the recording medium is present at said fixing-unit, controls a driving speed of said driving portion in accordance with a detecting result of said detection portion so that an amount of the loop of the recording medium becomes a predetermined amount, and in a second control time period after the first control time period, stops controlling the driving speed of said driving portion in accordance with a detecting result of said detection portion, calculates a plurality of target speeds based on the driving speed of said driving portion in the first control time period, and controls said driving portion using the plurality of calculated target speeds.

2. The driving device according to claim 1, wherein the second control time period includes a plurality of control time periods, and said control portions which controls said driving portion in each of the plurality of control time periods using a corresponding one of the plurality of calculated target speeds.

3. The driving device according to claim 1, further comprising a storage portion which stores, in advance, one or more coefficient data which are used in calculating one or more of the plurality of target speeds.

4. The driving device according to claim 3, further comprising a switching portion which switches the coefficient data in accordance with a parameter relating to occurrence of loop.

5. The driving device according to claim 4, wherein the parameter is at least one of conveying speed, basis weight of the recording medium, environmental temperature and environmental humidity.

6. A method for controlling a driving device which drives a fixing-unit for fixing a recording medium conveyed by a conveying portion for conveying the recording medium, the method comprising:

a step for detecting a loop of the recording medium when the recording medium is conveyed between the fixing-unit and the conveying portion;

a first control step for controlling, in a first control time period starting from the time when the recording medium is present at said fixing-unit, a driving speed of said driving device in accordance with a detecting result in said step for detecting so that an amount of the loop of the recording medium becomes a predetermined amount; and a second control step for controlling, in a second control time period after the first control time period, stopping controlling the driving speed of said driving device in accordance with a detecting result in said step for detecting, calculating a plurality of target speeds based on the driving speed of said driving device in the first control time period, and controlling said driving device using the plurality of calculated target speeds.

7. The control method according to claim 6, wherein the second control time period includes a plurality of control time periods, and said a second step further comprising the step for controlling said driving device in each of the plurality of control time periods using a corresponding one of the plurality of calculated target speeds.

8. An image forming apparatus comprising:

a transferring part which transfers an image to a recording material;

a fixing part which fixes the image transferred to the recording material by the transferring part;

a loop detection part which detects whether or not a loop is formed in the recording material between the transferring part and the fixing part;

a recording material detection part which detects the recording material; and a control part which controls a drive speed at which the fixing part is driven to convey the recording material, wherein the control part controls, in a first control time period starting from the time when the recording material is present at said fixing part, a driving speed of said fixing part in accordance with a detecting result of said loop detection part so that an amount of the loop of the recording material becomes a predetermined amount, and wherein the control part, in a second control time period after the first control time period, stops controlling the driving speed of said fixing part in accordance with a detecting result of said loop detection part, calculates a plurality of target speeds based on the driving speed of said fixing part in the first control time period, and controls said fixing part using the plurality of calculated target speeds.

9. The image forming apparatus according to claim 8, wherein the second control time period includes a plurality of control time periods, and said control part which controls said fixing part in each of the plurality of control time periods using a corresponding one of the plurality of calculated target speeds.

* * * * *